United States Patent [19]

Salger

[11] 3,989,168

[45] Nov. 2, 1976

[54] APPARATUS FOR REPLENISHING TONER IN THE DEVELOPMENT SYSTEM OF A COPYING MACHINE

[75] Inventor: Werner Salger, Hamburg-Langenhorn, Germany

[73] Assignee: Lumoprint Zindler KG, Hamburg, Germany

[22] Filed: Mar. 17, 1975

[21] Appl. No.: 558,681

[52] U.S. Cl. ..... 222/165

[51] Int. Cl.[2] ..... B67D 5/64

[58] Field of Search ..... 222/57, 163, 165, 325, 222/326

[56] References Cited

UNITED STATES PATENTS

| | | | |
|---|---|---|---|
| 1,753,278 | 4/1930 | Wostberg et al. | 222/165 X |
| 2,139,208 | 12/1938 | Rindl et al. | 222/165 |

*Primary Examiner*—Allen N. Knowles
*Assistant Examiner*—Hadd Lane
*Attorney, Agent, or Firm*—Toren, McGeady and Stanger

[57] ABSTRACT

In a copying machine, a container holds toner to be sprinkled on the selenium drum. Toner to replenish the amount consumed in making copies is directed from a supply vessel through a rotary slide valve into an inlet duct for the container. A container pocket for holding the toner supply vessel is mounted on and is rotatable with a part of the valve so that it can be located in an upper and a lower position. In the upper position the valve opens into the inlet duct, however, in the lower position the valve closes the opening into the duct and the supply vessel can be removed from the container pocket.

9 Claims, 3 Drawing Figures

1
2
3
4
5
6
7
8
9
10
11
12
13
14
58

APPARATUS FOR REPLENISHING TONER IN THE DEVELOPMENT SYSTEM OF A COPYING MACHINE

The invention relates to apparatus for replenishing toner in the development system of a copying machine comprising a drivable dispensing and proportioning element between an accumulation of toner in the development system and a mounting for a replaceable supply container for the toner, which permits pivoting of the supply container between a position with its aperture upwards and a working position with the aperture downwards.

In copying machines which have a transmission element that can be exposed to light, and on which the exposure to light produces physical properties for example electrical charges, in a pattern corresponding to the image, this pattern is developed by the application of toner. The developed image is then transferred to a receiving material and fixed thereon.

Toner is a development powder which colours the pattern of the image. The developer as a rule also contains carrier particles for the toner. During development, the toner becomes spent, so that either the toner by itself, or a mixture of toner and carrier particles, has to be fed from a supply container into the developer system.

In a device already described in German Pat. No. OS 2,213,390, a toner chamber is connected in series with the developer system in which are guided wire spirals which are driven at the bottom to serve as a dispensing and proportioning element, to act after the manner of worm conveyors. The toner chamber is sealed at the top by a hinged jointed portion of the housing on which is arranged the support for the supply container. In the housing portion there is a closable slide valve. After it has closed the housing portion can be slewed so that the mounting points downwards. In this position, the supply container can be changed. At the same time, the toner chamber is open at the top. Particularly during operation, that is, even during movement of the dispensing and proportioning element, swirling movement consequently occurs which is propagated into the apparatus. Replacement in operation is therefore, practically impossible. Moreover, the dispensing and proportioning element is rather complicated, and the supply container which has a relatively wide opening is emptied at the outset of the working position. The proportioning function is therefore incompletely carried out because the element operates non-uniformly, depending on the pressure of the accumulated supply of toner, that is, the remaining quantity to be supplied. The accumulation of toner moreover entails the risk of clogging.

It is known from German Pat. No. OS 2,004,568 that a supply container can be arranged in a fixed position, there being provided at the outlet a drum or roller which has on its outer surface open cellular cavities for receiving and storing the particles of the development powder. This drum which is of resilient plastics material is deformed in course of operation so that compression and closure of the open cellular cavities takes place. This device does not therefore operate uniformly in the long term.

The constrictions are necessary because they form counter-profilings for rails on the developer device, into which a supply container is inserted. In this known arrangement, the roller is rotatably mounted in the mouth of the supply container, so that here the advantage of a supply container which is regularly provided with a closing element is obtained, but the outlay is high in various respects. On the one hand the drum or roller and its mounting are removed in each case with the supply container, and since it is mainly disposable containers that are concerned, tend to be lost with the supply container. Moreover after use of the supply container, a coupling between a driving element and the roller must always be closed. Above all, however, the drum or roller mounted in the mouth of the supply container means that the developer device is open, with accumulated toner remaining therein, after the removal of a supply container, so that in regular operation, vapour formed in the developer device can emerge into the apparatus.

According to German Pat. No. OS 2,141,677, there is known that a supply container, in the form of a funnel with a lower opening which is matched to the periphery of a dispensing and proportioning drum or roller, can be installed rigidly in the developer device, and, after opening an upper lid, filled with toner by pouring this in. In this way the developer system indeed remains closed by the drum shaped dispensing and proportioning element, but the need to pour in the toner leads to considerable dust being deposited in the apparatus.

The invention has the object of providing an improved device of the aforementioned kind in that with the use of a simple supply container in the form of a bottle, all contamination of the apparatus during replacement is avoided, there being no pouring operation, and in that the developer system also remains closed while the supply container is being changed.

This problem is solved in accordance with the invention in that the mounting is adjustable as part of a rotary slide valve around the dispensing and proportioning element which forms in all positions a sealing means enclosed in the housing in front of the developer system. In this way, the supply container is connected with its aperture upwards that is without swirling of its contents, and in this position the dispensing and proportioning element remains upstream of the developer system and keeps the latter closed, while the dispensing and proportioning element, which carries remains of toner, is not exposed. It is therefore only by means of the invention that the supply container can be changed conveniently and without risk of contaminating the apparatus. Actuation is moreover simple.

It is an advantage for the mounting to be formed on the wall of an at least partially cylindrical housing arranged coaxially with the dispensing and proportioning element, and rotatable relative to the latter. Here, a dispensing and proportioning element shaped in particular as a drum or roller is used, and advantageously has the form of a circular brush. Other forms, for example of plastics material are also possible, and the mounting in the partly cylindrical housing avoids all deformation involving compression by inward radial pressure.

Preferably, the housing is in the form of a pot of which the wall closely surrounds the dispensing and proportioning element, there being provided on a portion of the wall a radially directed connection for mounting purposes. The advantage of the pot shaped design is that a rotatable element is created which acts as the rotary slide valve and facilitates the introduction of driving means for the dispensing and proportioning element.

At the same time, it is preferred that the pot shaped housing be axially guided at its base on a rotatable spindle mounted on the developer system and axially aligned with a driving shaft for the dispensing and proportioning element, which shaft traverses a counter-wall of the housing on which the free edge of the pot-shaped housing is carried. The counter wall is for preference connected with the developer system.

Sealed guidance for the two parts of the housing improved by mounting the pot-shaped housing for axial movement on the rotary spindle so as to be urged by a spring against the counter wall of the housing. It is preferred to provide here a groove shaped profile or the like in which the edge of the pot-shaped housing can slide.

It is preferred that the part of the housing forming the counter wall has in its lower region a duct leading into the developer device, and that the wall of the pot-shaped housing, on the portion of the periphery which is at the bottom when the container is slewed upwards, has a bend shaped as an outlet funnel, which comes to rest against a shoulder in the duct. The duct can easily be arranged on the part of the housing forming the counter wall, because this part of the housing is in any case rigidly connected with the developer device.

According to a further advantageous feature, a container pocket is pivotably carried in particular on the rotary spindle and/or the driving shaft, and a snap closure device is arranged on the container pocket which is open on one side which device, in the upward directed position of the container pocket can be brought into engagement with a counter-element in the developer system. The container pocket, which is open on one side, lies in its lower position with the opening free, so that a change of the supply container is readily possible, while in the upper position the open side of a wall faces the developer device.

The invention will be readily understood from the following illustrative description and the accompanying drawings, in which.

In all the Figures the same parts are denoted by the same reference numerals.

Figure 1:
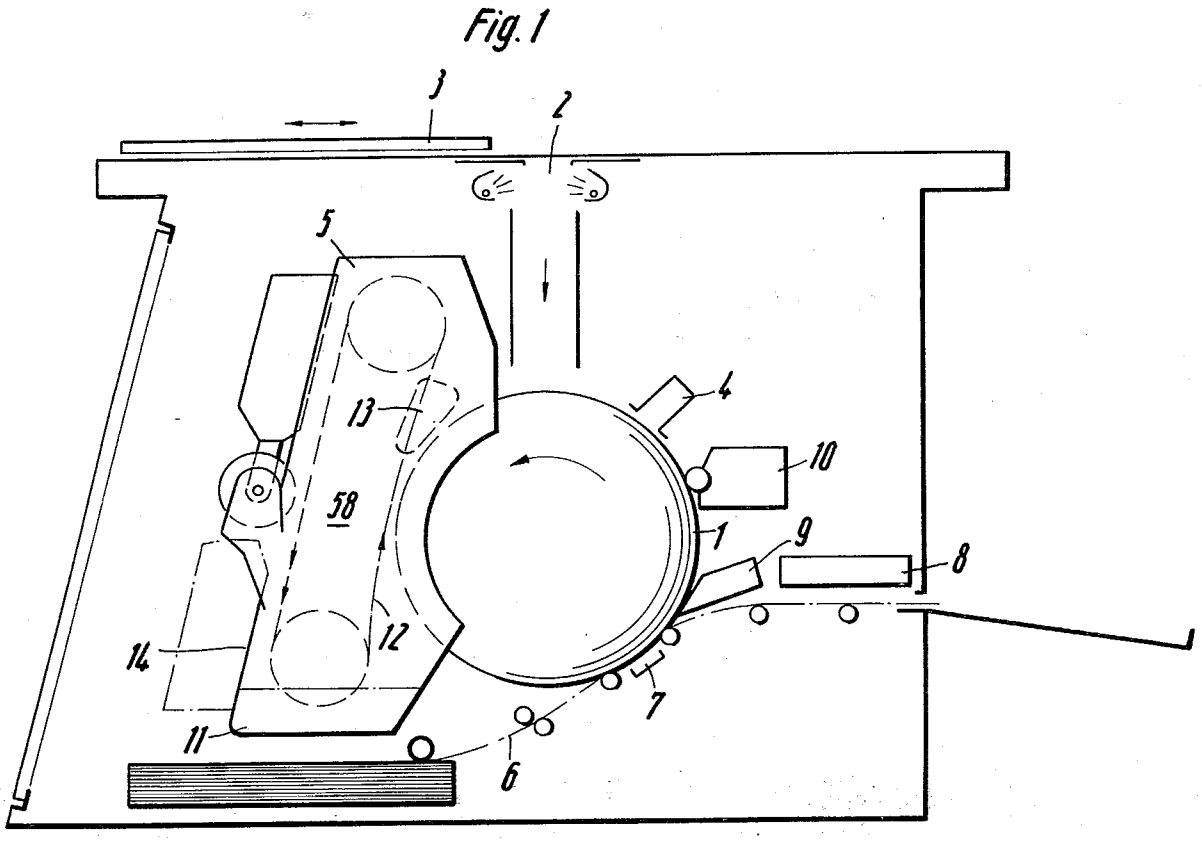
FIG. 1 is a schematic side view of a copier machine including a toner replenishment apparatus embodying the invention.

The copying machine shown in FIG. 1 has a transmission element in the form of a selenium drum 1 which is exposed to light through an exposure channel 2 and a lens (not shown in detail) from a receiver that can be moved to and fro on the upper side by means of a carriage 3. The drum rotates in a direction appropriate to the movement of the receiver. In front of the exposure channel 2, with reference to the direction of rotation, there is arranged a charging device 4, and behind the exposure duct, is a developer system 5. On the lower side of the drum 1 there is located a transport path 6 with driving elements by which copying material is taken to the drum, so as to receive the developed image, which material is supported by a discharge device 7. The transport path 6 then runs under a fusing or heating station 8 to a delivery aperture of the apparatus. A separator 9 is provided for assisting detachment of the sheets of copying material from the drum for onward passage to the transport path, and there is a cleaning device 10 for the drum. These parts so far described are shown only diagrammatically as they and their operation are known.

In the development system, a quantity of toner is located inside a container 58 from the bottom of which it is conveyed by a bucket conveyor 12 to a dispensing position 13, at which the toner is sprinkled on the periphery of the drum 1.

Figure 3:
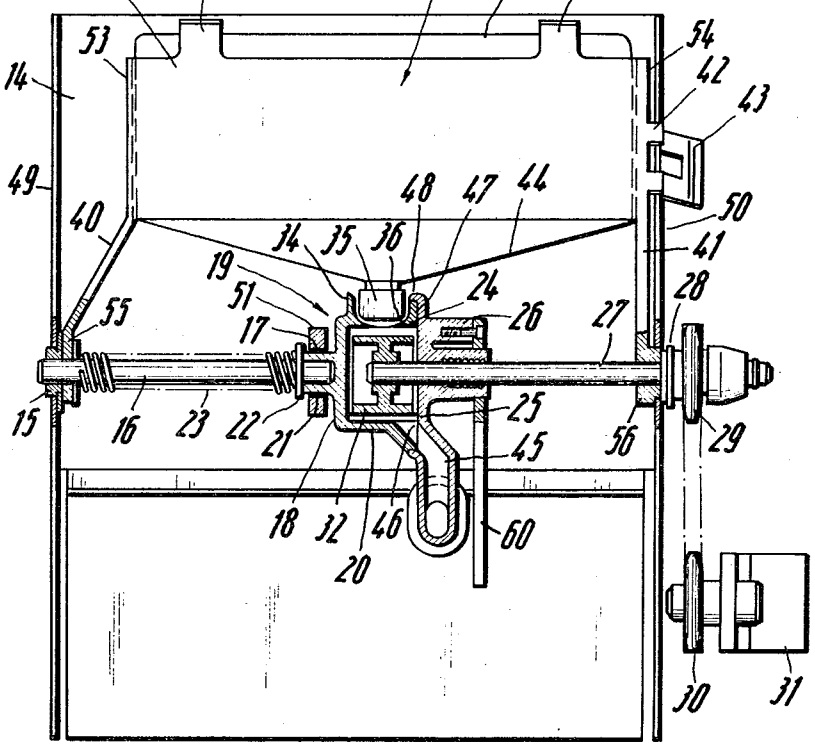
FIG. 3 is a view of the parts of the machine as shown in FIG. 2 but as seen from the left, in partial section.
Figure 2:
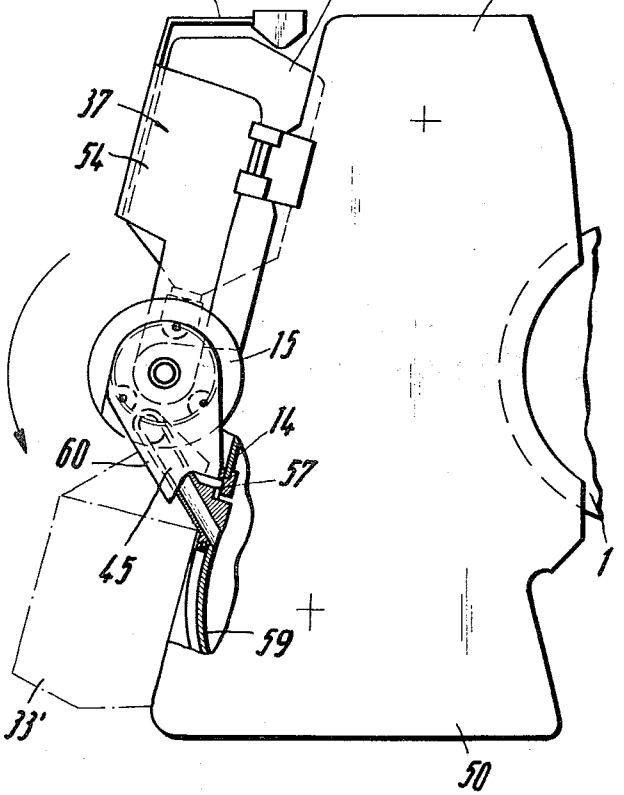
FIG. 2 is a partial view of the machine of FIG. 1 on an enlarged scale, partly in section and with parts broken away.

The container 58 of the development system has an inclined rear wall 14, which is also shown in FIGS. 2 and 3. The rear wall 14 is flanked by side walls 49, 50 which extend forwards in adjacency to the selenium drum 1 and effect a seal at the ends of this drum.

On the rear wall 14 or on the side wall 49 there is formed a bearing shoulder 15, of which the outline is shown in broken lines in FIG. 2. In this bearing shoulder 15 a rotary spindle 16 is mounted so as to be axially immovable with its other end engaged in a bushing or connector 17 at the base wall 18 of a pot-shaped housing 19 having a wall 20. The connector 17 is received for axial movement through another bearing 21 which is carried on a shoulder 51 formed on the rear wall. Between the bearing 15 and a disc 22 which is movably arranged on the rotary spindle 16, a pressure spring 23 is located which tends to shift the pot-shaped housing to the right as shown in FIG. 3, so that an edge 24 of the housing wall is pressed against a counter-wall 25. This counter-wall runs parallel to the base wall 18 and is formed as part of a housing 26 which is formed rigidly on the rear wall 14. The housing 26 is traversed by a driving shaft 27 which extends through an appropriate seal. The driving shaft 27 is mounted not only in the housing 26 but also in a bearing shoulder 28, which is formed either on the rear wall 14 or on the side wall 50, and corresponds to the bearing shoulder 15. On this driving shaft 27 there is secured a drive element 29, which is connected with a co-operating driving element 30 which is driven by its own motor 31 after the apparatus is switched on. Alternatively this drive is obtained from the general drive of the apparatus for example by a clutch which is in the form of a shifting coupling or clutch. In this way the driving shaft 27 is driven only cyclically.

At the end of the shaft 27 protruding into the housing 19, a dispensing or proportioning element 32 having the form of a drum or roller is mounted to rotate with the shaft, the element having an outer periphery running closely adjacent the cylindrical outline of the housing wall 20. The pot-shaped housing 19 is a part of a rotary slide valve to which also belong the parts 32 and 26 and the portions of and additions to the pot-shaped housing. As a mounting for a bottle-shaped supply container 33 there is formed in the housing wall 20 a connector 34, which in the working position shown is directed upwards. In this connector is mounted the relatively narrow neck 35 of the supply container 33 which neck is provided with an outer thread, the inner dimensions of the connector in relation to the thread being such that on securement together a sufficiently tight seal is obtained. At the same time, it should be remembered that inside the connector, at the bottom there is provided a stepped surface 36 which extends inwardly, against which rests the mouth of the bottle under the weight of the container. The container is moreover received in a container pocket 37 which in the working position has spring arms or hoops 38, 39 arranged at the top. These elastic spring hoops, which may be made of plastics material act on the bottle 33 to force its neck 35 into the connector 34.

The container pocket 37 is open on one side in that it has a wall 52 running parallel to the plane of the drawing of FIG. 3, and two side walls 53, 54 approximately at right angles thereto, so that there is produced a generally U-shaped cross-section, into which the supply container 33 can be inserted through the open side, when the container pocket is in the lower position shown in chain-dotted line in FIG. 2 the supply container is denoted by reference numeral 33'.

The pocket 37 is pivotably mounted by pivot arms 40, 41 on the rotary spindle 16 on one side and on the driving shaft 27 on the other. The bearing elements are denoted by 55 and 56. The bearing could instead be provided in another manner on only one of the two parts 16, 27 coaxially with these parts. In the upper position shown, the open side of the pocket 37 faces the wall 14, so that the supply container 33 rests against the wall and is locked in this position by a snap closure device consisting of elements 42, 43. Owing to the fact that the shoulder 44 adjoining the neck 35 of the container is funnel-shaped, the supply of toner automatically travels through the bottle neck 35 to its mouth and to the dispensing and proportioning element 32.

The housing part 26 forms a duct 45 which is directed obliquely downwards and transverses the rear wall 14 of the development system 5, so that the quantity of toner 11 in the container 58 is supplemented through this duct.

When the supply container 33 is empty, the snap closure device 42, 43 is opened and the pocket 37 with the supply container 33 therein is pivoted downwards into the position shown in FIG. 2 at 33'. The open side of the pocket is now in front, and the container can be drawn out downwards after forcing down the spring hoops 38, 39. The dispensing and proportioning element 32 remains in position and is always enclosed by the pot-shaped housing 19 and the counter wall 24 on the other side.

In the working position as shown in FIG. 3, the portion of the wall 20 then in the lower zone has a funnel-shaped bend 46 which ends in the duct 45 and furthers the delivery of the toner. On a rotation of the mounting formed by the connector 34, this bend moves upwards, and the duct 45 is then closed by wall portion 47 next to the connector 34 on the opposite wall 24. Both this wall portion 47 and also the outer end of the bend have the same radial distance from the rotation axis so that these parts can be guided within circular profiling 48 on the counter wall 24. Between the wall portion 47 particularly mentioned and the bend 46 there is an outwardly directed flange on the edge of the wall 20 of corresponding diameter guided in the profile 48.

It is also pointed out that the spring hoops 38, 39 are formed to extend from the wall 52 of the container pocket 37. The rear wall 14 is divided at 57, so that by removing the upper part of the rear wall access can be had to the containers 58 where the quantity of toner 11 remains in the lower part within a bowl 59 forming the rear wall. A special strut 60 serves for the rigid attachment of the housing 26 to the lower bowl 59 of the rear wall, when its upper section is removed. Owing to the conical design of the shoulder 44, the container pocket 37 with the supply container 33 therein can be tilted into the lower position, without encountering resistance, after which the supply container 33 can be removed, its neck 35 being directed with the opening upwards, but at the same time the access to the container 58 is closed by the design of the parts after the manner of a rotary slide valve. Accordingly, a new supply container, with its aperture upwards can be inserted and then pivoted into the working position shown in FIGS. 2 and 3 by making use of the rotary slide valve type of action.

The counter-wall 24 has a radial extent such that the bend 46 is covered on movement out of the position shown in FIG. 3; at least the counter wall is provided with such an extent on the wall part 47. It will be understood that in the event of a correspondingly large formation of the counter-wall, this is open at the point where the bend 46 coincides with the channel 45.

The snap closure parts 42, 43 comprise for example projections 42 on the container pocket and resilient flap 43 of which a marginal strip is brought over the projections and retained in that position as a result of its elasticity.

What we claim is:

1. In a copying machine having a development system wherein a toner can be applied to a surface having a chargeable area, container means in said development system for containing a supply of toner for the chargeable area a duct having a first end and a second end with the first end leading into said container means, a rotary slide valve mounted on said container means, the second end of said duct located at said valve, mounting positioned on said valve and arranged to receive the opening from a toner supply container, said valve having a rotatable first part and a second part with said second part fixed to said container means and to the second end of said duct, said mounting attached to said first part and rotatable therewith between an upper and a lower position, connector means on the rotatable first part of the valve, said connector means arranged for establishing communication through the second end of said duct in the upper position of the mounting and for sealing the second end of said duct in the lower position of the mounting for closing the second end of said duct.

2. The apparatus of claim 1 in which said rotatable first part has the form of a generally pot-shaped housing having a cylindrical wall on which the mounting is provided in the form of a connection for the neck of the supply container, in which bearing means for the pot-shaped housing are provided on the container in which means is provided to urge said pot-shaped housing against the non-rotatable fixed second part of said rotary slide valve.

3. The apparatus of claim 2 including an axial bearing at the base of said pot-shaped housing, a bearing element of said bearing means being traversed by said axial bearing, a rotational spindle received in said axial bearing, a bearing shoulder supporting said spindle for rotation but against axial movement, and a disc on said axial bearing, and a spring constituting said urging means acting between said disc and said bearing shoulder.

4. The apparatus of claim 2 in which a dispensing and proportioning element has a cylindrical shape and substantially fills the volume defined by said cylindrical wall of said pot-shaped housing, a driving shaft traverses the fixed second part of the rotary slide valve, a drive means connected to said driving shaft, said fixed second part forms a counter wall for the edge of the pot-shaped housing which is guided on this counter-wall, and the driving shaft being aligned with the rotational spindle.

5. The apparatus of claim 3 including a rotational axis for said rotary slide valve, a pivot bearing concentric with the rotational axis of the rotary slide valve, said container means having a rear wall, a container pocket mounted on said pivot bearing, said container pocket having a generally U-shaped cross-section with one leg of the U-shaped cross-section open and the pocket arranged to receive and hold a toner supply container, said pivot bearing and said container pocket being rotatable with said first part of said valve between the upper and lower positions of said mounting with the opening of the U-shaped cross-section facing upwardly in the upper position and downwardly in the lower position, and snap closure means provided on the container pocket and on the container means whereby the container pocket can be locked in the upper position in relation to the rotational axis, in which upper position the open leg of the U-shaped cross-section of the container pocket faces the rear wall of the container means.

6. The apparatus of claim 5 in which the dispensing and proportioning element is of cylindrical shape and substantially fills the corresponding cylindrical wall of the pot-shaped housing, a drive means traverses the fixed part of the rotary slide valve and communicates with the drive means, said fixed part forming a counter wall for the edge of the pot-shaped housing which is mounted on this counter wall, the drive shaft is aligned with the rotational spindle, at least one pivot arm is provided on the container pocket as part of the pivoting bearing, and the at least one pivot arm is pivotably mounted on at least one of the elements which surround the rotational spindle and the driving shaft.

7. The apparatus of claim 5 including spring hoop means on the container pocket on the side remote from the pivot bearing, said spring hoop means arranged to act resiliently on the bottom of a supply container for biasing the opening therefrom into the mounting constituted as a connection on said rotary slide valve.

8. The apparatus of claim 2 including as said connector means a bend in the wall of the pot-shaped housing at one edge thereof and in a peripheral section, said bend being generally opposite the mounting, and in which apparatus the fixed second part forms a counter wall of such an extent that the bend is located in the region of the counter wall, whereby with the first part of said valve in the upper position and with said mounting constituted as a connection turned upwardly said bend is located below said mounting and communicates with the second end of said duct, and with the first part of said valve in the lower position said mounting is turned downwardly and said bend is sealed by the counter wall.

9. A device according to claim 8 in which said counter-wall has a circular shape facing said pot-shaped housing, and said counter-wall being open in the zone of the second opening of said duct to afford communication between said pot-shaped housing and said duct.

* * * * *

UNITED STATES PATENT OFFICE
CERTIFICATE OF CORRECTION

Patent No. 3,989,168 Dated November 2, 1976

Inventor(s) Werner Salger

It is certified that error appears in the above-identified patent and that said Letters Patent are hereby corrected as shown below:

In the heading of the Patent the Foreign Application Priority Data has been omitted [30] and should read as follows:

-- [30] Foreign Application Priority Data

March 22, 1974 Germany.....P 24 13 873.6--.

Signed and Sealed this

Fourth Day of January 1977

[SEAL]

*Attest:*

RUTH C. MASON
*Attesting Officer*

C. MARSHALL DANN
*Commissioner of Patents and Trademarks*